US011244783B2

(12) United States Patent
Yen

(10) Patent No.: US 11,244,783 B2
(45) Date of Patent: Feb. 8, 2022

(54) STACKING INDUCTOR DEVICE

(71) Applicant: Realtek Semiconductor Corporation, Hsinchu (TW)

(72) Inventor: Hsiao-Tsung Yen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 667 days.

(21) Appl. No.: 16/157,502

(22) Filed: Oct. 11, 2018

(65) Prior Publication Data

US 2019/0214185 A1 Jul. 11, 2019

(30) Foreign Application Priority Data

Jan. 5, 2018 (TW) ..... 107100540

(51) Int. Cl.
*H01F 27/28* (2006.01)
*H01F 19/04* (2006.01)
*H01F 17/00* (2006.01)

(52) U.S. Cl.
CPC ..... *H01F 27/2823* (2013.01); *H01F 17/0013* (2013.01); *H01F 19/04* (2013.01);
(Continued)

(58) Field of Classification Search
CPC ..... H01F 27/2804; H01F 17/0006; H01F 17/0013; H01F 2017/0046;
(Continued)

(56) References Cited

U.S. PATENT DOCUMENTS

2011/0148733 A1* 6/2011 Fahs ..... H03H 7/42 343/859
2012/0242406 A1* 9/2012 Ke ..... H01F 27/2804 330/195

(Continued)

FOREIGN PATENT DOCUMENTS

CN 102693956 A 9/2012
CN 106710847 A 5/2017

(Continued)

OTHER PUBLICATIONS

U.S. Appl. No. 15/975,753, filed May 9, 2018.
U.S. Appl. No. 16/125,917, filed Sep. 10, 2018.

*Primary Examiner* — Tszfung J Chan
(74) *Attorney, Agent, or Firm* — Locke Lord LLP; Tim Tingkang Xia, Esq.

(57) ABSTRACT

A stacking inductor device includes a first inductor unit and a second inductor unit disposed above first inductor unit. First inductor unit includes a first and a second wire. First wire is disposed on a first side of first inductor unit. Second wire is disposed on a second side of first inductor unit. A first opening of second wire is disposed on a first side of stacking inductor device. Second inductor unit includes a third and a fourth wire. Third wire is disposed on a first side of second inductor unit, and first side of second inductor unit corresponds to first side of first inductor unit. A second opening of third wire is disposed on a second side of stacking inductor device. Fourth wire is disposed on a second side of second inductor unit, and second side of second inductor unit corresponds to second side of first inductor unit.

19 Claims, 7 Drawing Sheets

(52) U.S. Cl.
CPC . *H01F 27/2804* (2013.01); *H01F 2017/0073* (2013.01); *H01F 2027/2809* (2013.01)

(58) Field of Classification Search
CPC ..... H01F 2017/0073; H01F 2027/2809; H01F 5/003; H01F 27/2823; H01L 28/10; H01L 23/5227
USPC ..... 336/200, 223, 226, 232; 257/531
See application file for complete search history.

(56) References Cited

U.S. PATENT DOCUMENTS

| | | | | |
|---|---|---|---|---|
| 2015/0364243 | A1 | 12/2015 | Yen et al. | |
| 2016/0125995 | A1 * | 5/2016 | Armanious | H01F 17/0006 336/189 |
| 2017/0098500 | A1 | 4/2017 | Yen et al. | |

FOREIGN PATENT DOCUMENTS

| | | | | |
|---|---|---|---|---|
| TW | I553679 | B | 10/2016 | |
| TW | 201703070 | A | 1/2017 | |
| TW | I591800 | B | 7/2017 | |
| TW | I598899 | B | 9/2017 | |
| TW | 106139042 | | 11/2017 | |
| WO | WO-2014047106 | A1 * | 3/2014 | H01F 30/08 |

* cited by examiner

STACKING INDUCTOR DEVICE

RELATED APPLICATIONS

This application claims priority to Taiwan Application Serial Number 107100540, filed Jan. 5, 2018, which is herein incorporated by reference.

BACKGROUND

Field of Invention

The present disclosure relates to an inductor. More particularly, the present disclosure relates to a stacking inductor device.

Description of Related Art

Various types of prior art inductors have their own advantages and disadvantages, such as a spiral-type inductor. A spiral-type inductor has a higher quality value (Q value) and a greater mutual inductance value. However, both the mutual inductance and coupling of a spiral-type inductor occur between wires. For an eight-shaped inductor, since the magnetic fields induced by its two wires have opposite directions, the coupling and mutual inductance resulting from one wire are reflected by the coupled magnetic field resulting from the other wire. In addition, an eight-shaped inductor occupies a larger area in an apparatus. Additionally, although a stacking transformer occupies a smaller area, the Q value of a stacking transformer can not be optimized when compared with other types of transformers. As a result, the application ranges of the above inductor/transformer are all limited.

For the foregoing reasons, there is a need to solve the above-mentioned problems by providing a stacking inductor device, which the industry is eager to achieve.

SUMMARY

The summary aims to provide a brief description of the disclosure so as to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

One objective of the present disclosure is to provide a stacking inductor device so as to improve the prior art problems.

A stacking inductor device is provided. The stacking inductor device comprises first inductor unit and a second inductor unit. The second inductor unit is disposed above the first inductor unit. The first inductor unit comprises a first wire and a second wire. The first wire is disposed on a first side of the first inductor unit. The second wire is disposed on a second side of the first inductor unit opposite to the first side. The second wire comprises a first opening formed on a first side of the stacking inductor device. The second inductor unit comprises a third wire and a fourth wire. The third wire is disposed on a first side of the second inductor unit. The first side of the second inductor unit corresponds to the first side of the first inductor unit. The third wire comprises a second opening formed on a second side of the stacking inductor device opposite to the first side. The fourth wire is disposed on a second side of the second inductor unit opposite to the first side. The second side of the second inductor unit corresponds to the second side of the first inductor unit.

Therefore, the embodiments of the present disclosure provide a stacking inductor device based on technical content of the present disclosure so as to achieve better electrical characteristics.

Many of the attendant features will be more readily appreciated as the same becomes better understood by reference to the following detailed description considered in connection with the accompanying drawings.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

According to the usual mode of operation, various features and elements in the figures have not been drawn to scale, which are drawn to the best way to present specific features and elements related to the present disclosure. In addition, among the different figures, the same or similar element symbols refer to similar elements/components.

DESCRIPTION OF THE EMBODIMENTS

To make the contents of the present disclosure more thorough and complete, the following illustrative description is given with regard to the implementation aspects and embodiments of the present disclosure, which is not intended to limit the scope of the present disclosure. The features of the embodiments and the steps of the method and their sequences that constitute and implement the embodiments are described. However, other embodiments may be used to achieve the same or equivalent functions and step sequences.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular. Specifically, as used herein and in the claims, the singular forms "a" and "an" include the plural reference unless the context clearly indicates otherwise.

As used herein, "connect" refers to direct physical contact or electrical contact or indirect physical contact or electrical contact between two or more elements. Or it can also refer to reciprocal operations or actions between two or more elements.

Figure 1:
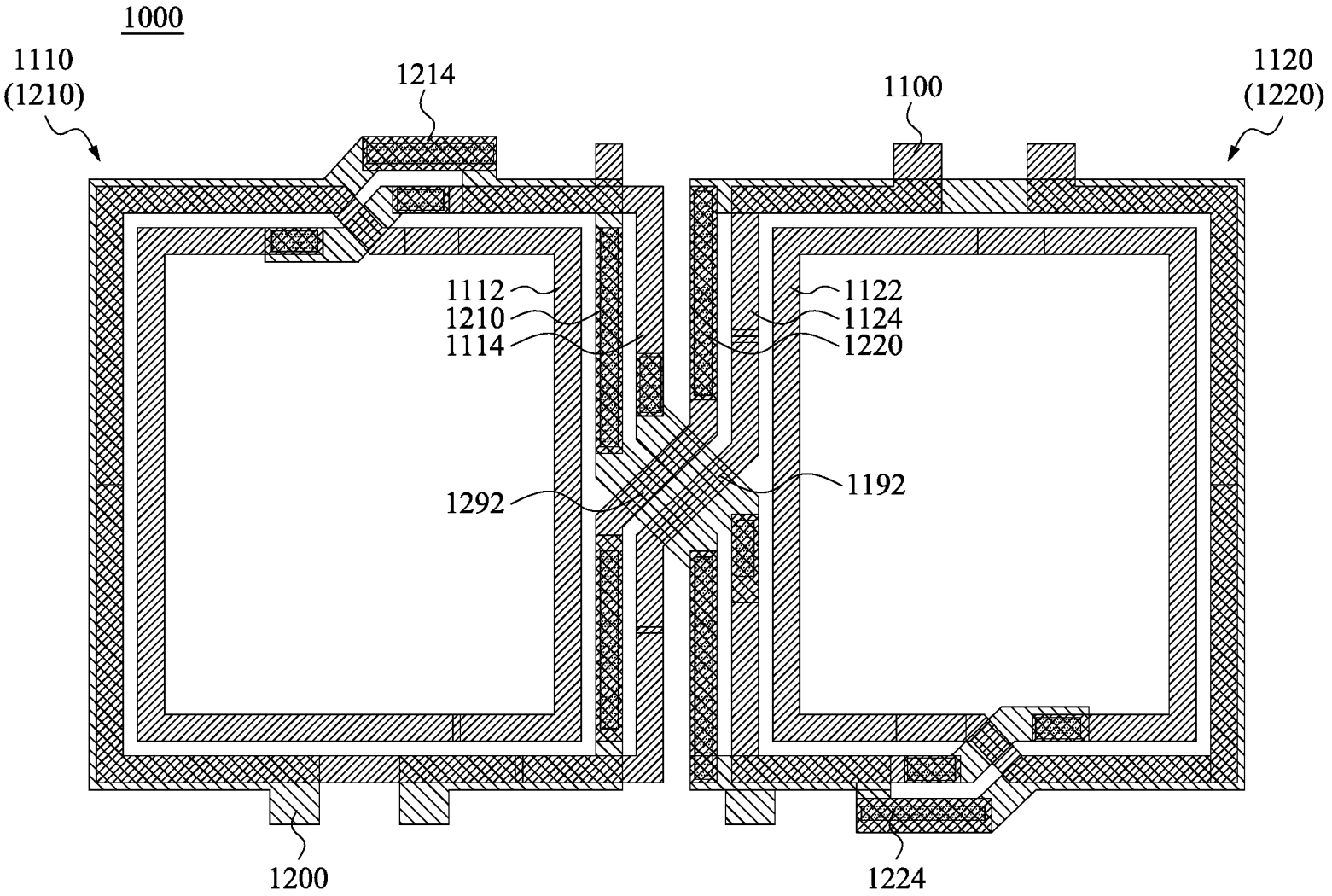
FIG. 1 depicts a schematic diagram of a stacking inductor device according to one embodiment of the present disclosure.

FIG. 1 depicts a schematic diagram of a stacking inductor device 1000 according to one embodiment of the present disclosure. It is noted that the stacking inductor device 1000 shown in FIG. 1 is an integral structure formed by stacking a first inductor unit 1100 and a second inductor unit 1200 comprised in the stacking inductor device 1000 (in the figure openings of the first inductor unit 1100 and the second inductor unit 1200 are labeled to facilitate distinguishing them). In order to facilitate understanding of the structure of the above stacking inductor device 1000, the stacking inductor device 1000 is split and depicted as the first inductor unit 1100 and the second inductor unit 1200 shown in FIG. 2 and FIG. 3, and a detailed description is provided as follows. It is noted that the openings of the first inductor unit 1100 and the second inductor unit 1200 depicted in FIG. 1 according to the present disclosure are located on upper and lower sides. In greater detail, the opening of the first inductor unit 110 is located on an upper right side in the figure, and the opening of the second inductor unit 1200 is located on a lower left side in the figure. However, the present disclosure is not limited in this regard. The openings of the first inductor unit 1100 and the second inductor unit 1200 may be located on left and right sides depending on practical needs. For example, the opening of the first inductor unit 1100 may be rotated by 90 degrees (such as being rotated 90 degrees clockwise) and disposed on the right side of the figure, and the opening of the second inductor unit 1200 may be rotated by 90 degrees (such as being rotated 90 degrees clockwise) and disposed on the left side of the figure.

Figure 2:
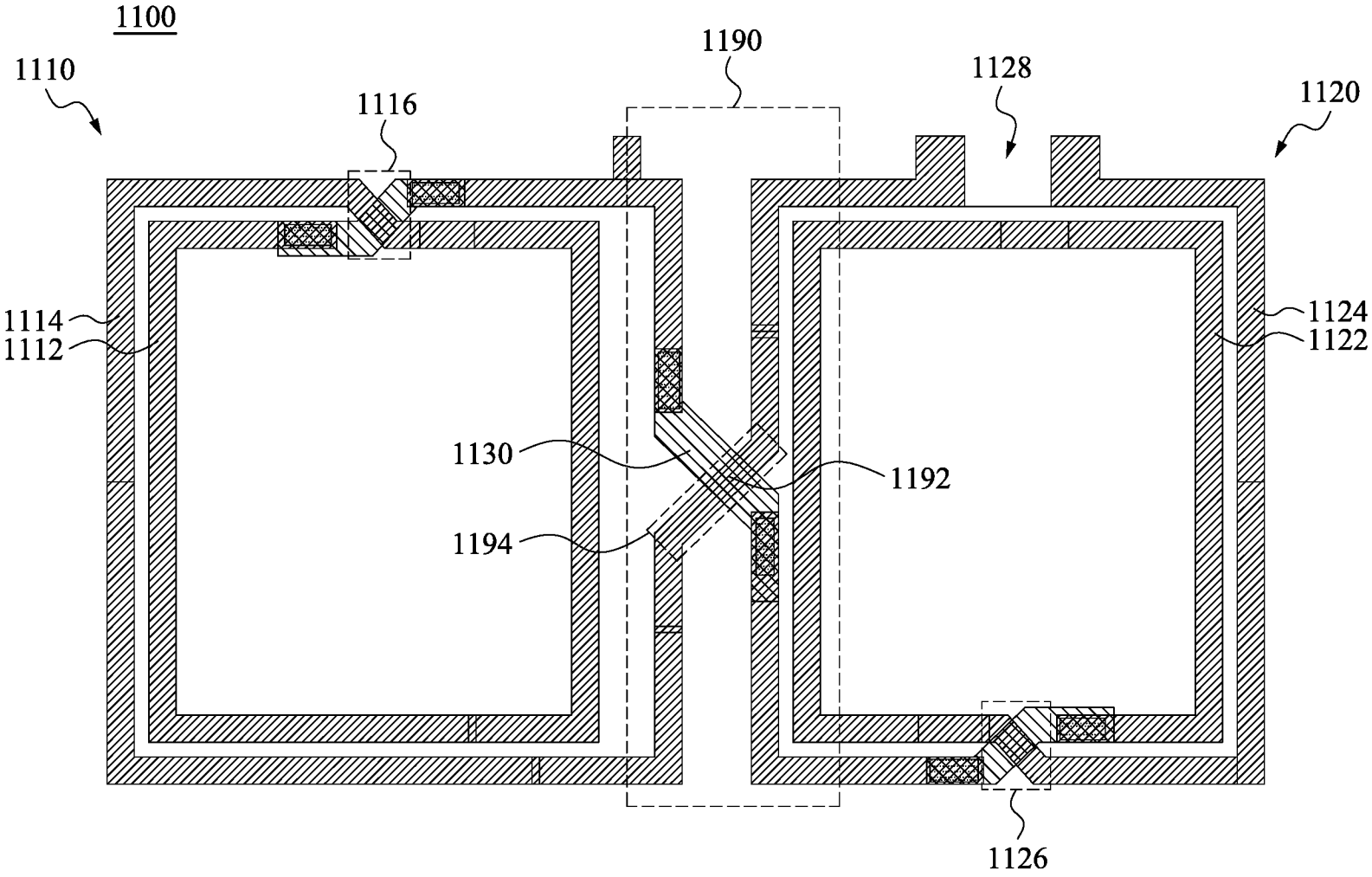
FIG. 2 depicts a schematic diagram of a partial structure of the stacking inductor device in FIG. 1 according to another embodiment of the present disclosure.

FIG. 2 depicts a schematic diagram of a partial structure of the stacking inductor device 1000 in FIG. 1 according to another embodiment of the present disclosure. As shown in the figure, the partial structure is the first inductor unit 1100 of the stacking inductor device 1000. The first inductor unit 1100 comprises a first wire 1100 and a second wire 1120. As for the structure, the first wire 1110 is disposed on a first side (such as a left side in the figure) of the first inductor unit 1100. The second wire 1120 is disposed on a second side (such as a right side in the figure) of the first inductor unit 1100 opposite to the first side. In addition, the second wire 1120 comprises a first opening 1128 formed on a first side (such as the upper side in the figure) of the stacking inductor device 1000 that is depicted in FIG. 1 correspondingly.

Figure 3:
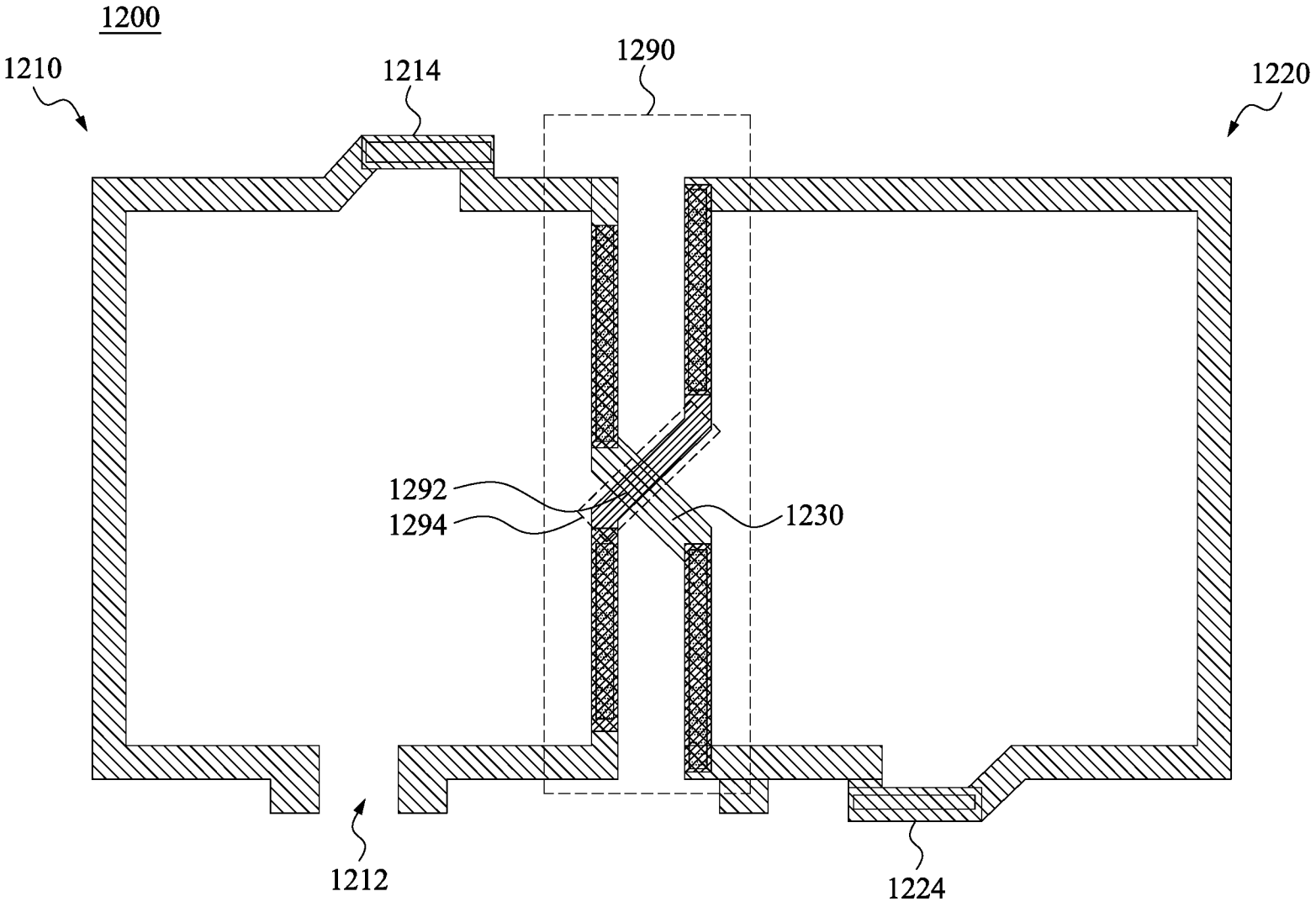
FIG. 3 depicts a schematic diagram of a partial structure of the stacking inductor device in FIG. 1 according to still another embodiment of the present disclosure.

FIG. 3 depicts a schematic diagram of a partial structure of the stacking inductor device 1000 in FIG. 1 according to still another embodiment of the present disclosure. As shown in the figure, the partial structure is the second inductor unit 1200 of the stacking inductor device 1000. The second inductor unit 1200 is disposed above the first inductor unit 1100 in FIG. 2 so as to form the stacking inductor device 1000 shown in FIG. 1. The second inductor unit 1200 comprises a third wire 1210 and a fourth wire 1220. As for the structure, the third wire 1210 is disposed on a first side (such as a left side in the figure) of the second inductor unit 1200. The first side of the second inductor unit 1200 corresponds to the first side of the first inductor unit 1100 shown in FIG. 2. The third wire 1210 comprises a second opening 1212 formed on a second side (such as the lower side in the figure), which is opposite to the first side, of the stacking inductor device 1000 that is depicted in FIG. 1 correspondingly. In addition, the fourth wire 1220 is disposed on a second side (such as a right side in the figure) of the second inductor unit 1200 opposite to the first side. The second side of the second inductor unit 1200 corresponds to the second side of the first inductor unit 1100 shown in FIG. 2.

In one embodiment, the first inductor unit 1100 shown in FIG. 2 is disposed on a first metal layer. The second inductor unit 1200 shown in FIG. 3 is disposed on a second metal layer on the first metal layer. In another embodiment, the first metal layer may be but not limited to an ultra thick metal (UTM) layer. The second metal layer may be but not limited to a re-distribution layer (RDL).

A description is provided with reference to FIG. 2 and FIG. 3. In some embodiments, the first wire 1110 and the second wire 1120 are cross-coupled at an adjacent portion 1190. Additionally, the third wire 1210 and the fourth wire 1220 are cross-coupled at an adjacent portion 1290.

A description is provided with reference to FIG. 2 and FIG. 3. In some embodiments, the first wire 1110 and the second wire 1120 are cross-coupled at a first cross coupling point 1192 in the adjacent portion 1190. In addition to that, the third wire 1210 and the fourth wire 1220 are cross-coupled at a second cross coupling point 1292 in the adjacent portion 1290. With additional reference to FIG. 1, the first cross coupling point 1192 does not overlap the second cross coupling point 1292.

A description is provided with reference to FIG. 2, the first wire 1110 and the second wire 1120 are coupled to a first coupling segment 1194 in one embodiment. In addition, the first inductor unit 1100 further comprises a first crossing member 1130. The first crossing member 1130 crosses the first coupling segment 1194 to couple the first wire 1110 and the second wire 1120. In another embodiment, a description is provided with reference to FIG. 3. The third wire 1210 and the fourth wire 1220 are coupled to a second coupling segment 1294. Additionally, the second inductor unit 1200 further comprises a second crossing member 1230. The second crossing member 1230 crosses the second coupling segment 1294 to couple the third wire 1210 and the fourth wire 1220. A description is provided with reference to FIG. 2 and FIG. 3. In some embodiments, the first coupling segment 1194, the second coupling segment 1294, and the first inductor unit 1100 are located on a same layer, such as all being located on the first metal layer. The first crossing member 1130, the second crossing member 1230, and the second inductor unit 1200 are located on a same layer, such as all being located on the second metal layer.

A description is provided with reference to FIG. 2 and FIG. 3. Each of the first wire 1110 and the second wire 1120 is winded into at least two turns. Each of the third wire 1210 and the fourth wire 1220 is winded into at least one turn.

A description is provided with reference to FIG. 2. In one embodiment, the first wire 1110 of the first inductor unit 1100 comprises a first turn 1112 and a second turn 1114. As for the structure, the second turn 1114 is disposed in a periphery of the first turn 1112. The first turn 1112 and the second turn 1114 are cross-coupled on a side corresponding to the first side of the stacking inductor device 1000 shown in FIG. 1 (such as an upper side in the figure). In addition to that, the second wire 1120 of the first inductor unit 1100 comprises a third turn 1122 and a fourth turn 1124. As for the structure, the fourth turn 1124 is disposed in a periphery of the third turn 1122. The third turn 1122 and the fourth turn 1124 are cross-coupled on a side corresponding to the second side of the stacking inductor device 1000 shown in FIG. 1 (such as a lower side in the figure).

In one embodiment, the first opening 1128 of the second wire 1120 is located on a side opposite to a position where the third turn 1122 and the fourth turn 1124 of the second wire 1120 are cross-coupled 1126 (such as the upper side in the figure).

A description is provided with reference to FIG. 1 to FIG. 3. The third wire 1210 is disposed above the second turn 1114 of the first wire 1110. The fourth wire 1220 is disposed above the fourth turn 1124 of the second wire 1120.

In one embodiment, a description is provided with reference to FIG. 3. The third wire 1210 comprises a first detouring member 1214. The first detouring member 1214 is located on a side opposite to the second opening 1212 of the third wire 1210 (such as an upper side in the figure). Additionally, a description is provided with reference to FIG. 2 and FIG. 3. The first detouring member 1214 is located on a same side (such as the upper side in the figure) as a position where the first turn 1112 and the second turn 1114 of the first wire 1110 are cross-coupled 1116, and the first detouring member 1214 does not overlap the position where the first turn 1112 and the second turn 1114 are cross-coupled 1116.

A description is provided with reference to FIG. 3. In another embodiment, the fourth wire 1220 comprises a second detouring member 1224. The second detouring member 1224 is located on a side opposite to the first opening 1128 of the second wire 1210 that is depicted in FIG. 2 correspondingly (such as the lower side in the figure). Additionally, a description is provided with reference to FIG. 2 and FIG. 3. The second detouring member 1224 is located on a same side (such as the lower side in the figure) as a position where the third turn 1122 and the fourth turn 1124 of the second wire 1120 are cross-coupled 1126, and the second detouring member 1224 does not overlap the position where the third turn 1122 and the fourth turn 1124 are cross-coupled 1126.

A description is provided with reference to FIG. 1 to FIG. 3. In the adjacent portion 1190 of the first wire 1110 and the second wire 1120, or in the adjacent portion 1290 of the third wire 1210 and the fourth wire 1220, the first turn 1112 of the first wire 1100, the third wire 1210, the second turn 1114 of the first wire 1110, the fourth wire 1220, the second turn 1224 of the second wire 1120, and the first turn 1122 of the second wire 1120 are arranged in sequence.

A description is provided with reference to FIG. 1 to FIG. 3. In the adjacent portion 1190 of the first wire 1110 and the second wire 1120, or in the adjacent portion 1290 of the third wire 1210 and the fourth wire 1220, the first turn 1112 of the first wire 1100, the third wire 1210, the second turn 1114 of the first wire 1110, the fourth wire 1220, the second turn 1224 of the second wire 1120, and the first turn 1122 of the second wire 1120 do not overlap one another.

Figure 4:
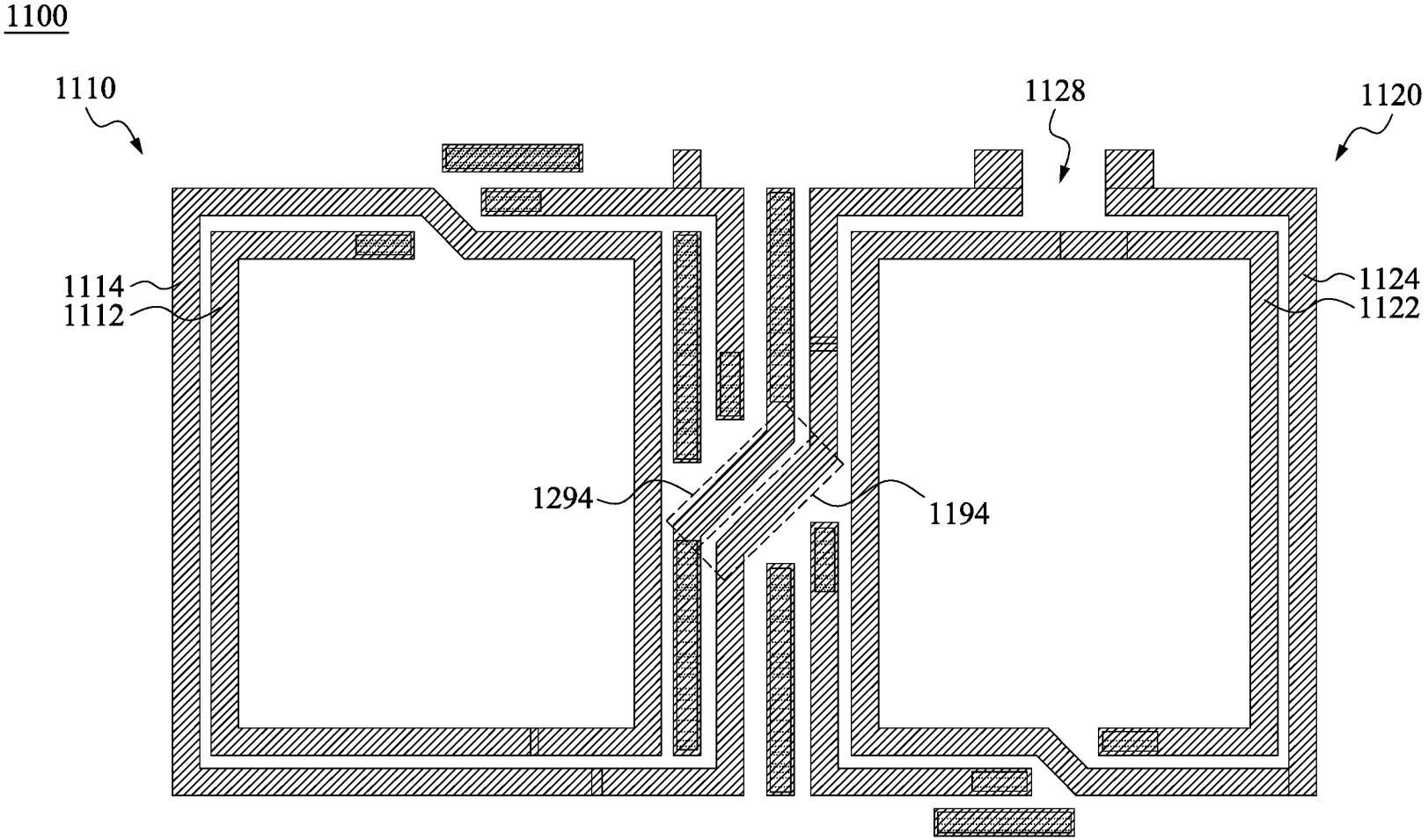
FIG. 4 depicts a schematic diagram of a partial structure of the stacking inductor device in FIG. 1 according to yet another embodiment of the present disclosure.
Figure 5:
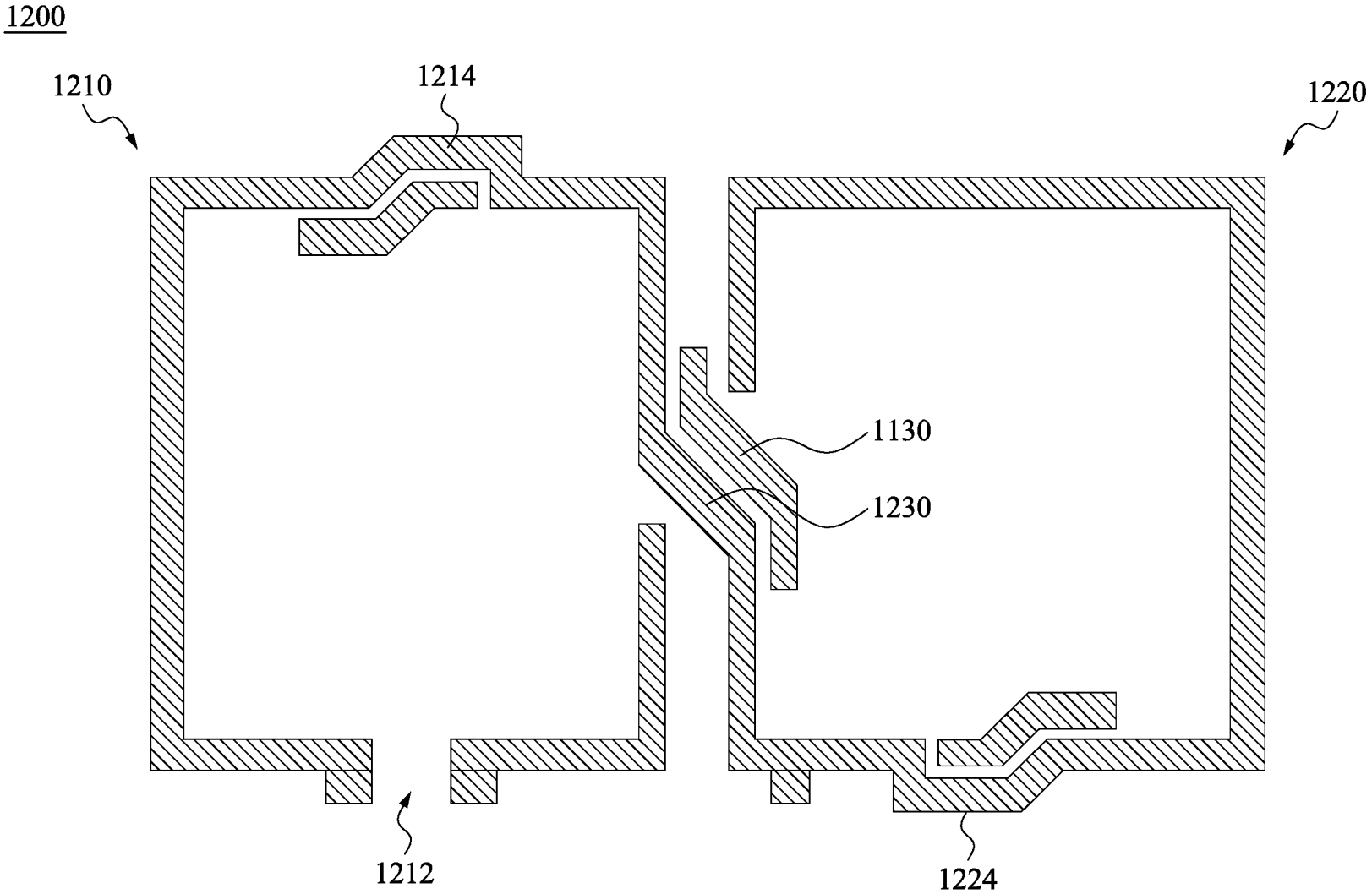
FIG. 5 depicts a schematic diagram of a partial structure of the stacking inductor device in FIG. 1 according to another embodiment of the present disclosure.

FIG. 4 depicts a schematic diagram of a partial structure of the stacking inductor device 1000 in FIG. 1 according to yet another embodiment of the present disclosure. As compared with FIG. 2, in FIG. 4 a structure on a same metal layer is depicted in a same figure to facilitate understanding of the structure of the present disclosure. FIG. 5 depicts a schematic diagram of a partial structure of the stacking inductor device 1000 in FIG. 1 according to another embodiment of the present disclosure. As compared with FIG. 3, in FIG. 5 a structure on a same metal layer is depicted in a same figure to facilitate understanding of the structure of the present disclosure. The same reference numerals in FIG. 4 to FIG. 5 and FIG. 1 to FIG. 3 refer to the same components. Relationships between the components have been described in the above embodiments, and a description in this regard is not provided. It is noted that, as can be seen from FIG. 4 and FIG. 5, each of the structures on the same layers is mostly symmetrical in the stacking inductor device 1000. As a result, all the related electrical characteristics of the stacking inductor device 1000 are superior to those of common inductor structures.

Figure 6:
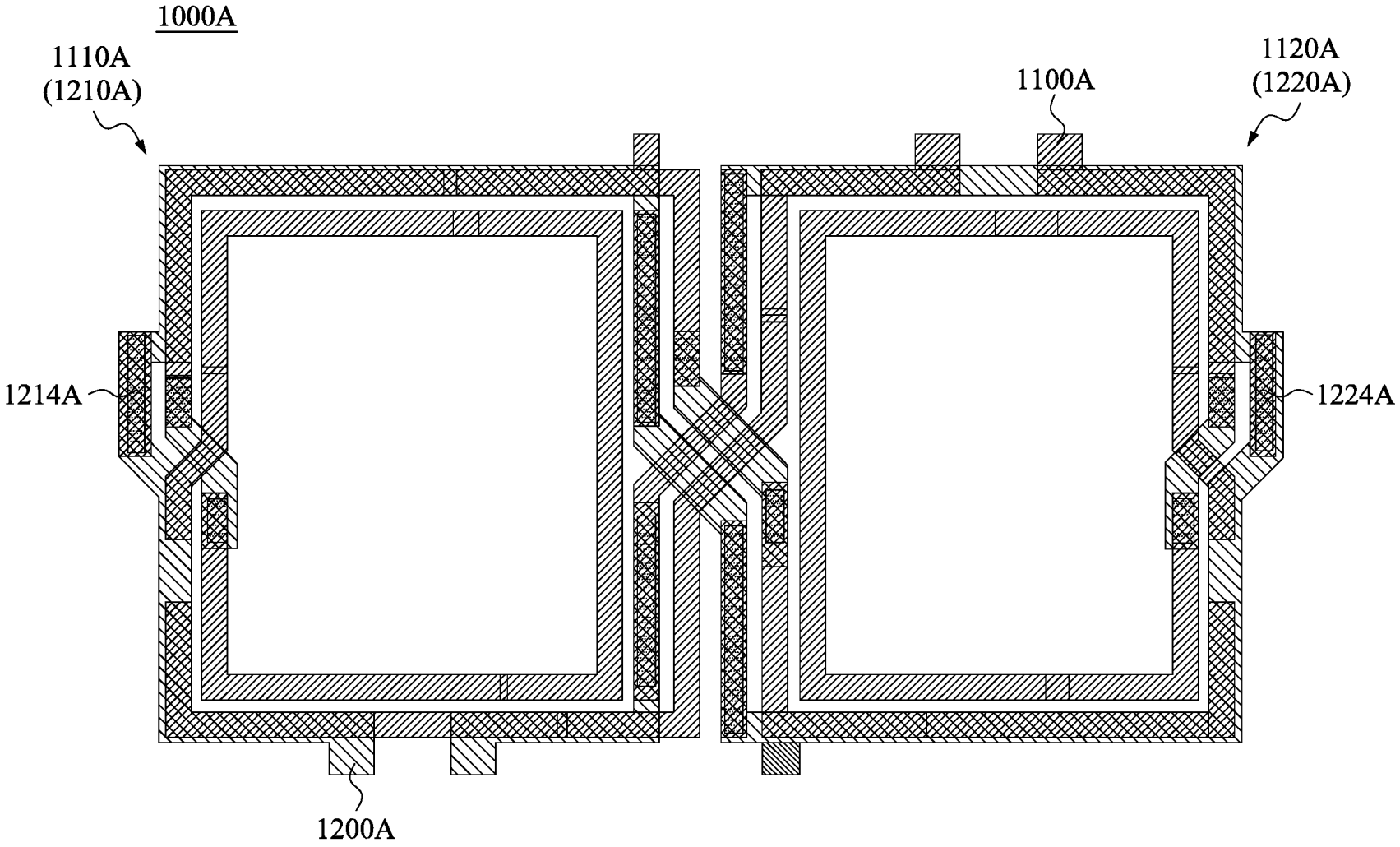
FIG. 6 depicts a schematic diagram of a stacking inductor device according to one embodiment of the present disclosure.

FIG. 6 depicts a schematic diagram of a stacking inductor device 1000A according to one embodiment of the present disclosure. As compared with the stacking inductor device 1000 shown in FIG. 1, a first turn and a second turn of a first wire 1110A of a first inductor unit 1100A of the stacking inductor device 1000A shown in FIG. 6 are cross-coupled on a left side in the figure. A first detouring member 1214A of a second inductor unit 1200A is also disposed on the left side of the figure correspondingly. Additionally, a third turn and a fourth turn of a second wire 1120A of the first inductor unit 1100A of the stacking inductor device 1000A shown in FIG. 6 are cross-coupled on a right side in the figure. A second detouring member 1224A of the second inductor unit 1200A is also disposed on the right side of the figure correspondingly.

Figure 7:
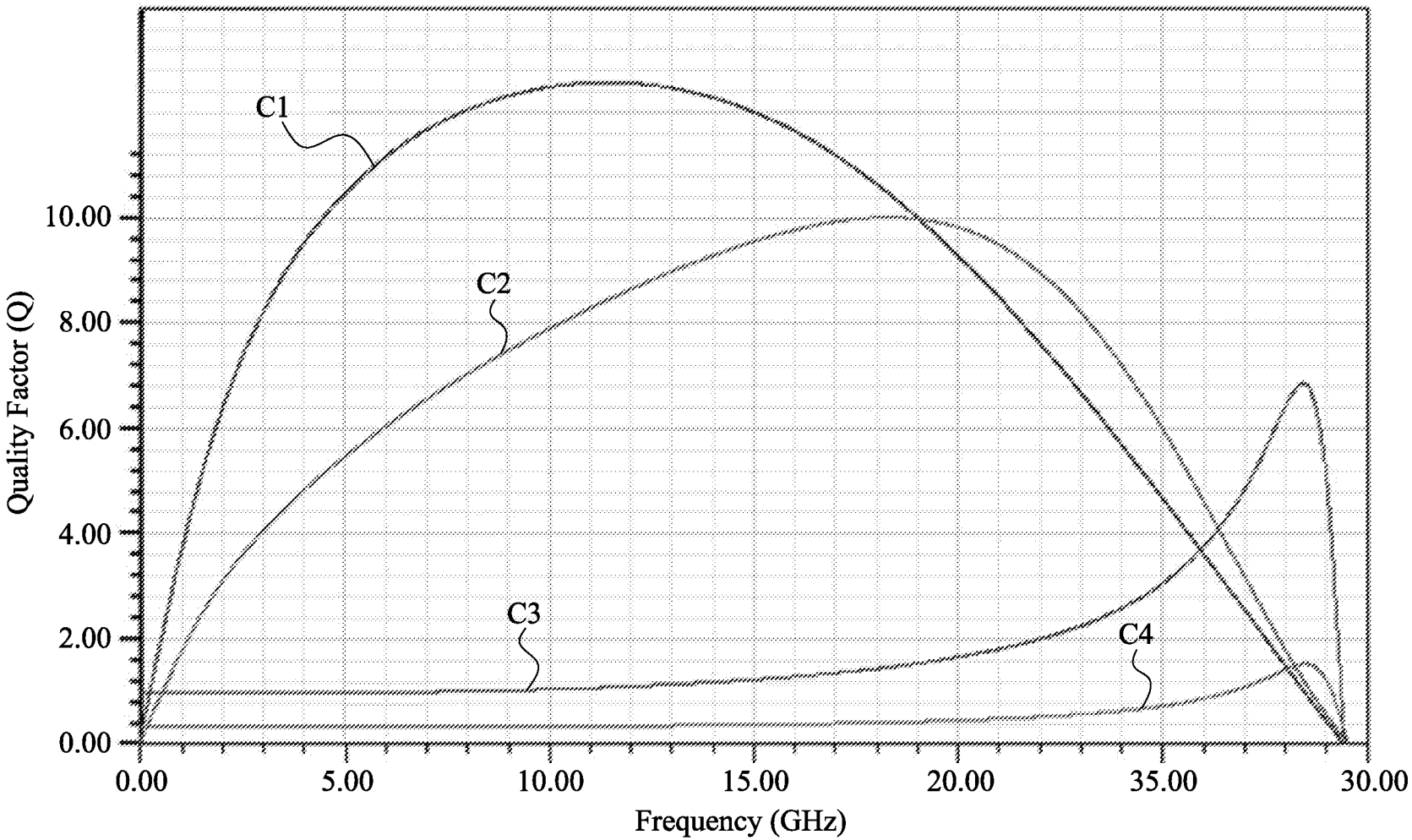
FIG. 7 depicts experimental data curves of a stacking inductor device according to one embodiment of the present disclosure.

FIG. 7 depicts experimental data curves of a stacking inductor device according to one embodiment of the present disclosure. The experimental data curves illustrate a Q factor and an inductance value of the inductor device under different frequencies. As shown in the figure, curve C1 is a quality factor curve of the first inductor unit 1100 of the stacking inductor device 1000 according to the present disclosure. Curve C2 is a quality factor curve of the second inductor 1200 of the stacking inductor device 1000 according to the present disclosure. Curve C3 is an inductance value curve of the first inductor unit 1100 according to the present disclosure. Curve C4 is an inductance value curve of the second inductor unit 1200 according to the present disclosure. It can be seen from the experimental data in FIG. 7 that the quality factor of the stacking inductor device can reach about 11. Therefore, the electrical characteristics of the stacking inductor device 1000 according to the present disclosure are superior. However, the present disclosure is not limited to the numerical values provided in the above embodiments, and those skilled in the art may adjust the above numerical values depending on practical needs to achieve the optimum efficacy.

It is understood from the embodiments of the present disclosure that application of the present disclosure has the following advantages. The embodiments of the present disclosure provide a stacking inductor device to achieve superior electrical characteristics (for example, the stacking inductor device has a higher quality factor) so as to improve the efficacy of the stacking inductor device.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A stacking inductor device comprising:

a first inductor unit comprising:

a first wire disposed on a first side of the first inductor unit; and a second wire disposed on a second side of the first inductor unit opposite to the first side, the second wire comprising:

a first opening formed on a first side of the stacking inductor device; and a second inductor unit disposed above the first inductor unit, the second inductor unit comprising:

a third wire disposed on a first side of the second inductor unit, wherein the first side of the second inductor unit corresponds to the first side of the first inductor unit, wherein the third wire comprises:

a second opening formed on a second side of the stacking inductor device opposite to the first side of the stacking inductor device;

a fourth wire disposed on a second side of the second inductor unit opposite to the first side of the second inductor unit, wherein the second side of the second inductor unit corresponds to the second side of the first inductor unit;

wherein the first wire and the second wire are coupled to a first coupling segment, the first inductor unit further comprises a first crossing member, the first crossing member crosses the first coupling segment to couple the first wire and the second wire;

wherein the first wire of the first inductor unit comprises:

a first turn; and a second turn disposed in a periphery of the first turn;

wherein the second wire of the first inductor unit comprises:

a third turn; and a fourth turn disposed in a periphery of the third turn, wherein the second turn and the fourth turn are coupled by the first coupling segment and the first crossing member.

2. The stacking inductor device of claim 1, wherein the first inductor unit is disposed on a first metal layer, the second inductor unit is disposed on a second metal layer on the first metal layer.

3. The stacking inductor device of claim 1, wherein the first wire and the second wire are cross-coupled at one adjacent portion, the third wire and the fourth wire are cross-coupled at another adjacent portion.

4. The stacking inductor device of claim 3, wherein the first wire and the second wire are cross-coupled at a first cross coupling point in the one adjacent portion, the third wire and the fourth wire are cross-coupled at a second cross coupling point in the another adjacent portion, wherein the first cross coupling point does not overlap the second cross coupling point.

5. The stacking inductor device of claim 1, wherein the third wire and the fourth wire are coupled to a second coupling segment, wherein the second inductor unit further comprises a second crossing member, the second crossing member crosses the second coupling segment to couple the third wire and the fourth wire.

6. The stacking inductor device of claim 5, wherein the first coupling segment, the second coupling segment, and the first inductor unit are located on a same layer.

7. The stacking inductor device of claim 5, wherein the first crossing member, the second crossing member, and the second inductor unit are located on a same layer.

8. The stacking inductor device of claim 1, wherein each of the first wire and the second wire is winded into at least two turns, each of the third wire and the fourth wire is winded into at least one turn.

9. The stacking inductor device of claim 8, wherein the first turn and the second turn are cross-coupled on the first side of the stacking inductor device;

wherein the third turn and the fourth turn are cross-coupled on the second side of the stacking inductor device.

10. The stacking inductor device of claim 9, wherein the first opening of the second wire is located on a side opposite to a position where the third turn and the fourth turn of the second wire are cross-coupled.

11. The stacking inductor device of claim 10, wherein the third wire is disposed above the second turn of the first wire, the fourth wire is disposed above the fourth turn of the second wire.

12. The stacking inductor device of claim 11, wherein the third wire comprises a first detouring member, the first detouring member is located on a side opposite to the second opening of the third wire, wherein the first detouring member is located on a same side as a position where the first turn and the second turn of the first wire are cross-coupled, and the first detouring member does not overlap the position where the first turn and the second turn are cross-coupled.

13. The stacking inductor device of claim 12, wherein the fourth wire comprises a second detouring member, the second detouring member is located on a side opposite to the first opening of the second wire, wherein the second detouring member is located on a same side as a position where the third turn and the fourth turn of the second wire are cross-coupled, and the second detouring member does not overlap the position where the third turn and the fourth turn are cross-coupled.

14. The stacking inductor device of claim 13, wherein the first turn of the first wire, the third wire, the second turn of the first wire, the fourth wire, the second turn of the second wire, and the first turn of the second wire are arranged in sequence in an adjacent portion of the first wire and the second wire.

15. The stacking inductor device of claim 14, wherein the first turn of the first wire, the third wire, the second turn of the first wire, the fourth wire, the second turn of the second wire, and the first turn of the second wire do not overlap one another in the adjacent portion of the first wire and the second wire.

16. The stacking inductor device of claim 8, wherein the first turn and the second turn are cross-coupled on one side opposite to an adjacent side of the first wire and the second wire;

wherein the third turn and the fourth turn are cross-coupled on one side opposite to the adjacent side of the second wire and the first wire.

17. The stacking inductor device of claim 16, wherein the third wire is disposed above the second turn of the first wire, the fourth wire is disposed above the fourth turn of the second wire.

18. The stacking inductor device of claim 17, wherein the third wire comprises a first detouring member, wherein the first detouring member is located on a same side as a position where the first turn and the second turn of the first wire are cross-coupled, and the first detouring member does not overlap the position where the first turn and the second turn are cross-coupled.

19. The stacking inductor device of claim 18, wherein the fourth wire comprises a second detouring member, wherein the second detouring member is located on a same side as a position where the third turn and the fourth turn of the second wire are cross-coupled, and the second detouring member does not overlap the position where the third turn and the fourth turn are cross-coupled.

* * * * *